US006941996B2

(12) United States Patent
Ward et al.

(10) Patent No.: US 6,941,996 B2
(45) Date of Patent: Sep. 13, 2005

(54) DOUBLE SHADE WITH MODULAR END CAPS AND METHOD OF ASSEMBLING SAME

(75) Inventors: Adam Ward, Madison, WI (US); Toralf H. Strand, Madison, WI (US)

(73) Assignee: Springs Window Fashions LP, Fort Mill, SC (US)

( * ) Notice: Subject to any disclaimer, the term of this patent is extended or adjusted under 35 U.S.C. 154(b) by 152 days.

(21) Appl. No.: 10/442,610

(22) Filed: May 21, 2003

(65) Prior Publication Data

US 2004/0231804 A1 Nov. 25, 2004

(51) Int. Cl.[7] ..... A47H 1/00

(52) U.S. Cl. ..... 160/89; 160/108; 160/178.2 R

(58) Field of Search ..... 160/89, 84.03, 160/84.04, 108, 178.2 R, 321, 323.1, 405

(56) References Cited

U.S. PATENT DOCUMENTS

| | | | | |
|---|---|---|---|---|
| 203,414 | A | | 5/1878 | Buckley et al. |
| 553,143 | A | | 1/1896 | Watts |
| 792,548 | A | | 6/1905 | Oliver |
| 927,090 | A | | 7/1909 | Anderson |
| 1,409,451 | A | | 3/1922 | Jaeger |
| 1,601,665 | A | | 9/1926 | Alphin |
| 1,636,601 | A | | 7/1927 | Givens |
| 1,731,124 | A | | 10/1929 | Carper |
| 2,140,049 | A | | 12/1938 | Grauel |
| 2,175,761 | A | | 10/1939 | Quinlan |
| 2,201,356 | A | | 5/1940 | Terrell |
| 2,350,094 | A | | 5/1944 | Butts |
| 2,509,033 | A | | 5/1950 | Carver |
| 3,727,665 | A | * | 4/1973 | Debs ..... 160/178.2 |
| 4,069,857 | A | | 1/1978 | Brookshire |
| 4,327,797 | A | * | 5/1982 | Nakajima et al. ..... 160/168.1 R |
| 4,347,885 | A | | 9/1982 | von Knorring et al. |
| 4,372,432 | A | * | 2/1983 | Waine et al. ..... 192/223.4 |
| 4,476,910 | A | | 10/1984 | Saito |
| 4,647,488 | A | | 3/1987 | Schnebly et al. |
| 4,651,795 | A | | 3/1987 | Valle et al. |
| 4,719,956 | A | | 1/1988 | Valle |
| 4,724,885 | A | | 2/1988 | Chang |
| 4,953,610 | A | | 9/1990 | Phillips et al. |
| 4,974,656 | A | | 12/1990 | Judkins |
| 5,167,269 | A | | 12/1992 | Abo |
| 5,205,334 | A | | 4/1993 | Judkins |
| RE34,273 | E | | 6/1993 | Phillips et al. |
| 5,275,222 | A | | 1/1994 | Jelic et al. |
| D348,371 | S | | 7/1994 | Judkins |
| 5,361,822 | A | | 11/1994 | Nijs |
| 5,375,643 | A | | 12/1994 | Rude |
| D355,093 | S | | 2/1995 | Morris |
| D355,094 | S | | 2/1995 | Josephson |
| 5,472,036 | A | | 12/1995 | Judkins |
| 5,505,418 | A | | 4/1996 | Corcoran |
| 5,647,421 | A | | 7/1997 | Hoffmann et al. |
| D385,449 | S | | 10/1997 | Morris |
| 6,070,639 | A | | 6/2000 | Winston et al. |
| D445,621 | S | | 7/2001 | Judkins |
| 6,712,115 | B2 | * | 3/2004 | Judkins ..... 160/32 |

FOREIGN PATENT DOCUMENTS

| | | |
|---|---|---|
| EP | 0 690 199 | 1/1996 |
| WO | WO-93/07353 | 4/1993 |

* cited by examiner

*Primary Examiner*—David Purol
(74) *Attorney, Agent, or Firm*—Lerner, David, Littenberg, Krumholz & Mentlik, LLP

(57) ABSTRACT

A double shade is disclosed as well as a method of assembling same. The double shade includes a headrail, a first shade mounted at its upper end to the bottom surface of the headrail and operable with lift cords, and a first control module mounted at a side edge of the headrail including a cord lock for operating the first shade. A second shade is mounted to a roller positioned within the interior of the headrail. A second control module is mounted at the opposite side edge of the headrail, and includes a clutch that is operable by a cord loop to move the second shade up and down and hold it in a desired location.

19 Claims, 3 Drawing Sheets

DOUBLE SHADE WITH MODULAR END CAPS AND METHOD OF ASSEMBLING SAME

FIELD OF THE INVENTION

This invention relates to window coverings and, more particularly, to double shades which include two different shade materials that are mounted parallel to each other which are independently controllable so that the user can raise and lower each of the two shades separately.

BACKGROUND OF THE INVENTION

The past several decades have been marked by tremendous growth in the types of window covering materials that are available to purchasers. Starting with roller shades and slatted horizontal blinds, the field of window coverings has blossomed to include a wide array of different types of coverings. These have included pleated shades, Roman shades, cellular shades, and many others.

Among these many choices, there are shade materials which are transparent to some degree, as well as shade materials which are much more opaque, keeping out a much greater degree of light and providing a greater degree of privacy than is offered by shade materials that are substantially transparent.

In recent years, the window covering industry has seen the advent and increased popularity of double shades. As illustrated, for example, in U.S. Pat. No. 5,205,334 in the name of Ren Judkins, double shades provide an opportunity to employ two completely different types of shades mounted together to cover the same window. With such double shades, the user has the ability to deploy only the first of the two shades (which may, for example, be a relatively sheer pleated shade), or to only deploy the second shade, which may be a more opaque roller shade, or to deploy both at the same time. Double shades are often purchased and manufactured on a custom basis, with the customer not only selecting the two shade fabrics, but also dimensions calculated to accurately cover the customer's window.

All of these choices present manufacturers with various challenges. Whatever type of shade the customer may choose, and whatever size may be needed by the customer, the manufacturer must be able to provide the double shade with those selections in a completed shade that includes a headrail and the appropriate controls for raising and lowering each of the two shades.

Double shades should preferably be as compact as possible. Systems which simply join two shades together are likely to be bulky and awkward, are likely to have a headrail that is as large as (or even larger than) two separate headrails that are simply tied together, thus wasting space and material, and may even need to be mounted independently. In addition, double shades should avoid, to the extent possible, light gaps which allow light to enter a room around the edges of the shades.

Moreover, a system is needed whereby double shades can be custom built to the customer's requirements in an economic fashion by fabricators and others who wish to minimize the costs associated with maintaining inventories of various components. With particular regard, for example, to headrails used with double shades, the width of the headrail will be a function of the width of the individual customer's window. If one wished to maintain stock sizes, a substantial number of sizes would have to be inventoried. Even if one were willing to maintain a smaller number of stock sizes of headrails and trim them to size, there would inevitably be a degree of waste of material. It would be more economical to be able to maintain long lengths of headrail that can be cut individually to the exact size needed with a minimum amount of waste.

It is also desirable that the headrail per se not have any finished openings, such as an opening to receive lift or control cords. Since such finished openings must be smooth and attractive, they will typically have to be made at a factory.

The hardware needed for raising and lowering the shades and holding them in a desired position presents similar challenges in the environment of double shades. Certain types of shades are best used with lift cords which include cord locks, such as pleated shades, while certain other types of shades are most effectively used with clutch mechanisms, such as roller shades. It would be particularly beneficial for fabricators and other manufacturers to be able to select the two mechanisms that are most appropriate for the two shades that are going to be employed on a particular double shade.

Thus, a need has arisen for a system for manufacturing double shades that provides a simple and compact construction, minimization of light gaps, flexibility to manufacturers in terms of width of the shade, the fabrics used on the shade, and the hardware for operating the shades, and which also minimizes labor, tooling and the need for extensive inventory of numerous components.

SUMMARY OF THE INVENTION

The present invention addresses the foregoing needs.

In accordance with the present invention, a double shade includes a longitudinally extending headrail which is adapted to be mounted to a stationary surface, and which has a front surface, a bottom surface and first and second side edges. First and second shades have upper and lower ends. The first and second shades are mounted at their respective upper ends to the headrail and adapted to move in substantially parallel planes between raised positions and lowered positions.

A first control module is mounted at the first side edge of the headrail. The first control module includes a mechanism for moving the first shade between raised and lowered positions and for holding the first shade at positions between the raised and lowered positions. A second control module is mounted at the second side edge of the headrail. The second control module includes a mechanism for moving the second shade between raised and lowered positions and for holding the second shade at positions between the raised and lowered positions.

In accordance with a preferred embodiment of the invention, one of the shades is raised and lowered with at least one lift cord, and a corresponding one of the control modules includes a cord lock, with the lift cord extending through the cord lock and outward from the control module.

In accordance with another preferred embodiment, one of the control modules includes a clutch mounted within the control module to selectively drive a roller to raise and lower a shade, and a cord loop which drives the clutch extends outward from the control module.

The present invention also includes a method of assembling a double shade. A longitudinally extending headrail having a front surface, a bottom surface and first and second side edges is provided. A first shade is mounted to the headrail. A first control module is mounted at the first side edge of said headrail, with the first control module including a mechanism for moving the first shade between raised and lowered positions and for holding the first shade at positions between the raised or lowered positions. A second shade is mounted to the headrail. A second control module is mounted at the second side edge of the headrail, with the second control module including a mechanism for moving the second shade between raised and lowered positions and for holding the second shade at positions between the raised and lowered positions.

The present invention also includes a cord lock comprising a cord lock container adapted to be mounted in a vertical plane. A retaining roller is rigidly mounted within the container. A movable member has a rotary member mounted thereon, with the movable member being free to move within the vertical plane between a first position in which the rotary member is located sufficiently close to the retaining roller to prevent movement of a lift cord positioned therebetween, and a second position in which a lift cord is free to move between the rotary member and the retaining roller. A spring biases the movable member toward the first position. A release cord is attached to the movable member and is adapted to move the movable member away from the first position and toward the second position when the release cord is pulled.

BRIEF DESCRIPTION OF THE DRAWINGS

A more complete appreciation of the subject matter of the present invention and the various advantages thereof can be realized by reference to the following detailed description in which reference is made to the accompanying drawings in which.

DETAILED DESCRIPTION OF THE PREFERRED EMBODIMENTS

Figure 1:
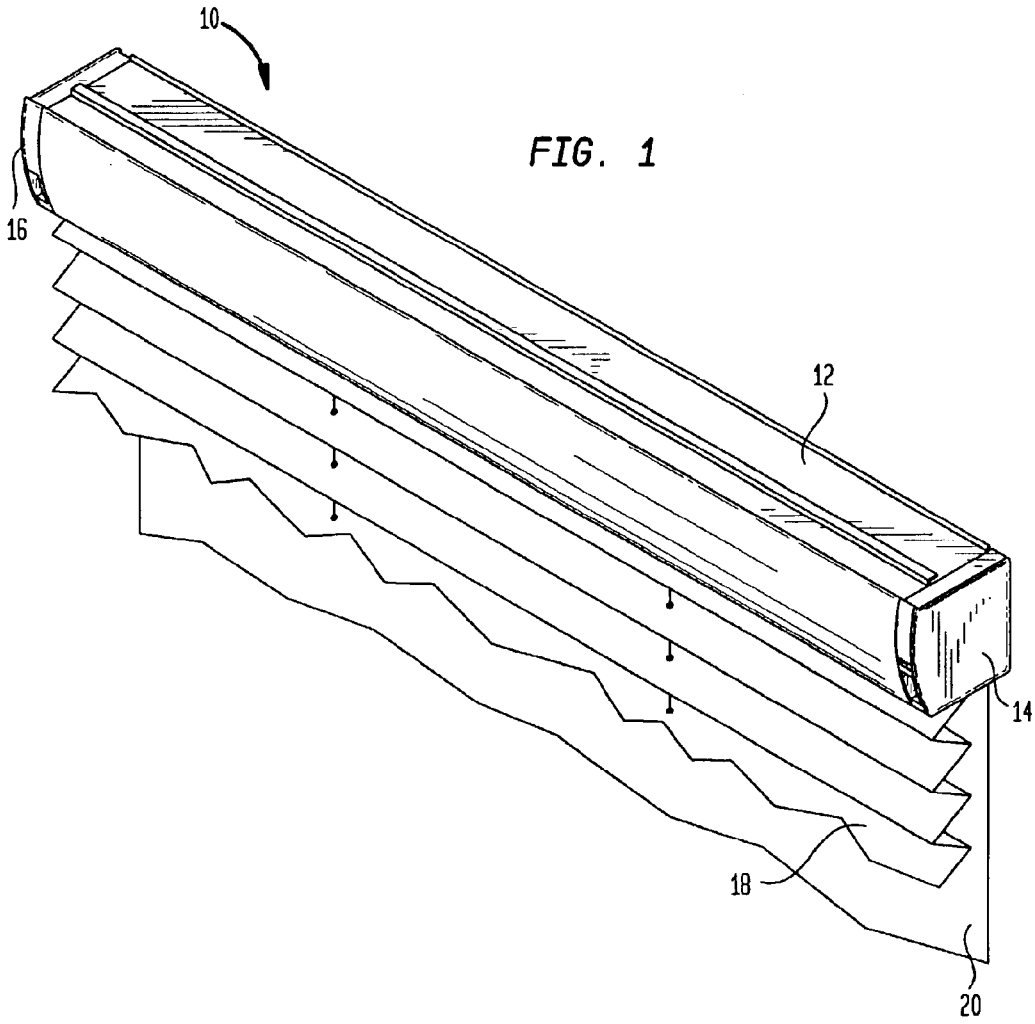
FIG. 1 is a front perspective view of the double shade of the present invention showing portions of the two shades in a position in which both shades are deployed.
Figure 2:
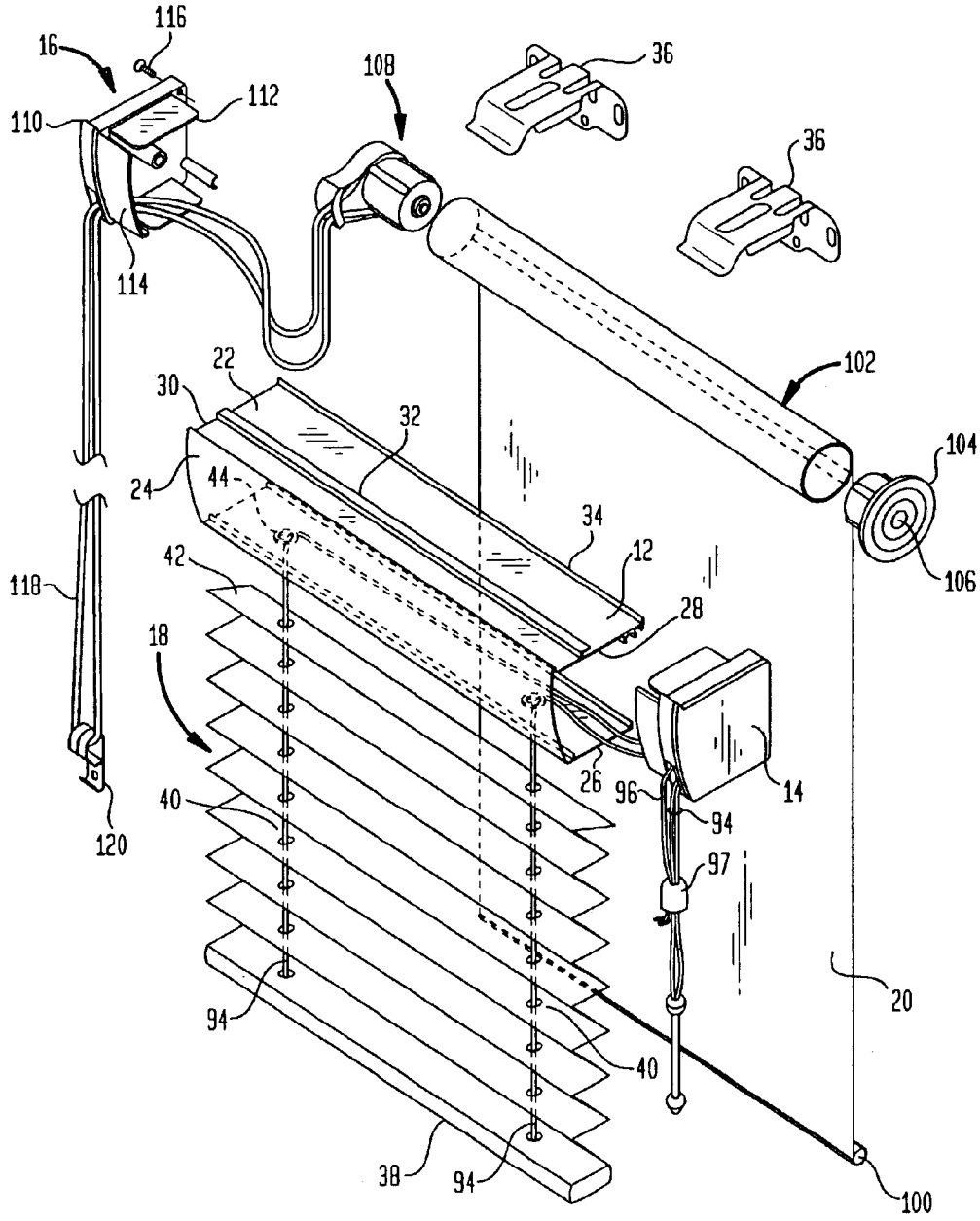
FIG. 2 is an exploded perspective view of the double shade of the present invention.
Figure 3:
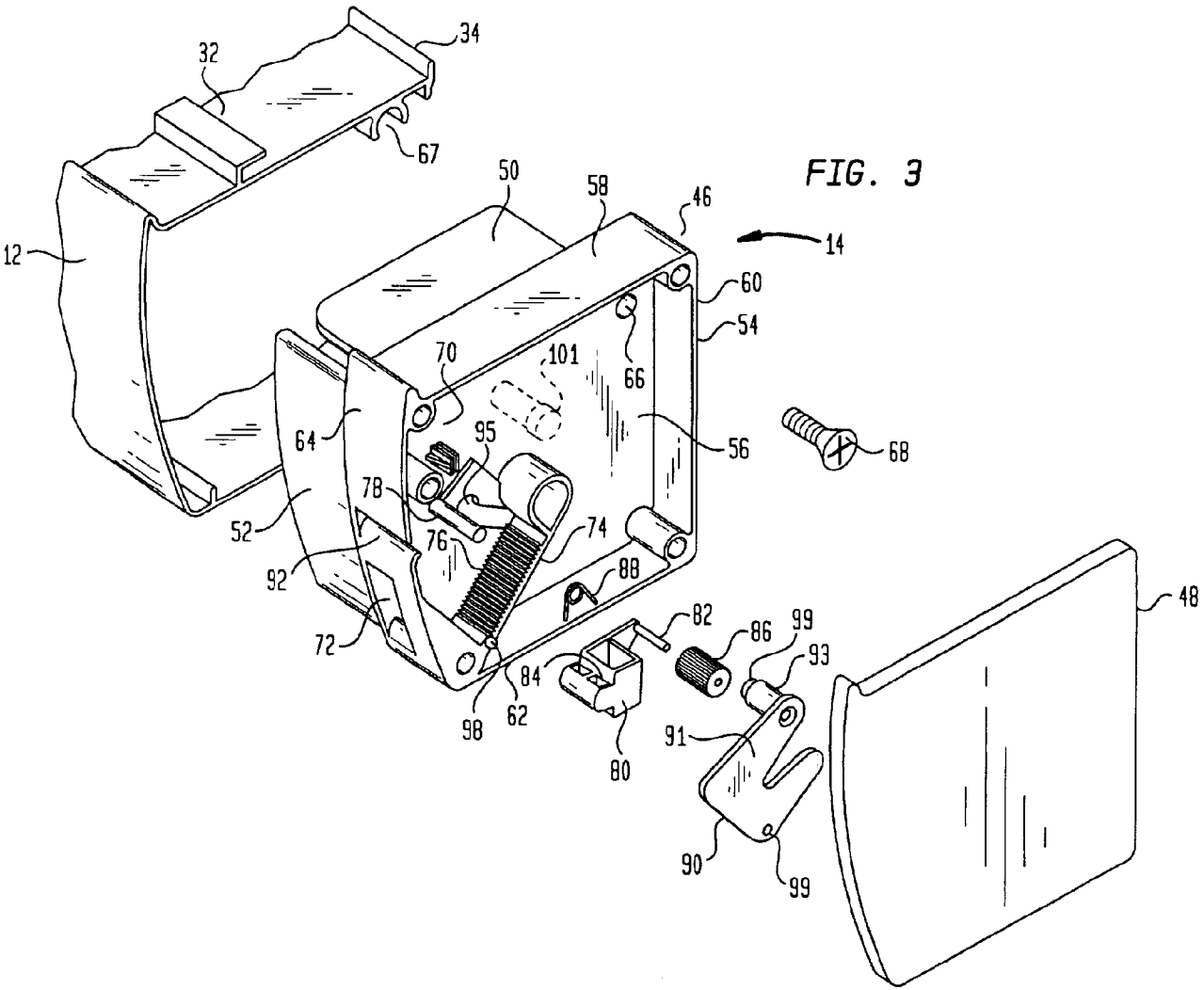
FIG. 3 is an exploded perspective view of the control module on the right-hand side of the double shade shown in FIGS. 1 and 2.

Turning now to the drawings and particularly to FIGS. 1–3, the double shade of the present invention is shown generally by reference numeral 10. The double shade 10 consists generally of headrail 12, first control module 14, second control module 16, first shade 18 and second shade 20.

As best shown in FIG. 2, headrail 12 is a generally U-shaped plastic or metal extrusion which extends longitudinally between first control module 14 and second control module 16. The headrail 12 generally includes a top wall 22, a front surface 24, a bottom surface 26, a first side edge 28 and a second side edge 30. The headrail 12 is essentially open at its rear.

Formed on top surface 12, as part of the same extrusion, are extensions 32 and 34, which are best shown in FIG. 3. Extensions 32 and 34 are designed to engage with mounting brackets 36, which in turn are mounted to a fixed surface in a manner that is well known to those skilled in this art. It is noted at this juncture that because the second shade 20 emerges from the rear of headrail 12, it is essential that the extensions 32 and 34 and the mounting clips 36 be designed in such a manner as to position the headrail 12 in a manner such that it allows the second shade 20 to move in and out of the headrail 12 without obstruction.

As seen in FIGS. 1 and 2, first shade 18 is designed to be positioned in front of the second shade 20. As illustrated herein, first shade 18 is a conventional accordion pleated shade. However, first shade 18 can be numerous other types of shades, such as Roman shades, cellular shades, horizontal blinds and the like. First shade 18 includes a bottom rail 38 which adds weight to the first shade 18 and assists in lowering the first shade 18 as desired.

The first shade 18 is raised and lowered by means of conventional lift cords. To accommodate such cords, holes 40 are placed in desired locations along vertical lines going through each pleat of the first shade 18, in conventional fashion. The lift cords themselves (not shown) are fastened to the bottom rail 38 in conventional fashion. It will be appreciated by those skilled in the art that in some instances, relatively small shades can be satisfactorily operated with only two lift cords. In larger shades, a greater number of lift cords may be needed. The selection of the appropriate number of lift cords is a matter well known to those skilled in the art.

The upper end 42 of the first shade 18 is affixed to the bottom surface 26 of the headrail 12. It is necessary to drill holes 44 in the bottom surface 26 for the lift cords which correspond to the holes 40 in the first shade 18. With aligned sets of holes having been made in the first shade 18 and the bottom surface 26, the top portion 42 of the first shade 18 is affixed to the bottom surface 26 of the headrail 12 by means of rivets, eyelets or the like, or any other satisfactory mounting scheme, so long as the lift cords may proceed through the holes 40 and the holes 44 without impediment. The mounting may be assisted with a strip of rigid plastic material having adhesive on one side being placed over the top pleat of shade 18, with eyelets affixing the plastic strips and the top pleat to the headrail. Because holes 44 are not visible when the shade is mounted, they can be punched or drilled by equipment that is commonly available to fabricators and other manufacturers.

The first shade 18 may actually be wider than headrail 12. Thus, when the first and second modules 14 and 16 are mounted to the headrail 12, the first shade 18 may extend across a substantial portion (or even the entirety) of the bottom surfaces of the modules 14 and 16. This allows the first shade 18 to be almost as wide as the fully assembled headrail-and-modules combination, thus minimizing the light gap that might otherwise exist if the shade 18 was narrower.

The lift cords are thus routed from the bottom rail 38 through the holes 40 and the holes 44 into the headrail 12, where they are collected to be routed into and through a cord lock. In the present illustrative embodiment, the cord lock is contained in the first control module 14, which will now be described.

As best shown in FIG. 3, the first control module 14 includes cord lock container 46 and end plate 48. The cord lock container 46 includes extension members 50 and 52, which are designed to be slidably inserted within closely fitting openings within the headrail 12, and are thus not visible when the double shade 10 is fully assembled. The remainder of the cord lock container 46 includes a box-like member 54 which includes a generally flat inner wall 56, top wall 58, rear wall 60, bottom wall 62 and front wall 64. Inner wall 56 rests substantially flush with first side edge 28 of headrail 12. A screw opening 66 is provided through which a screw 68 can be inserted and self-threadingly screwed into U-shaped opening 67 within the headrail 12 so as to firmly hold the cord lock container 46 to the headrail.

Within the cord lock container 46 is cord lock 70. Cord lock 70 can be any one of a number of commercially available cord locks such as those shown in U.S. Pat. Nos. 5,275,222 and 5,472,036, which are incorporated herein by reference, as well as the preferred cord lock now described.

One preferred embodiment of the cord lock container 46 is illustrated in greater detail in FIG. 3. Formed integrally with inner wall 56 is ramp member 74 which has, on one side, serrated surface 76. Also formed integrally with the inner wall 56 is spring mounting pin 78. Positioned generally between serrated surface 76 and spring mounting pin 78 is moveable member 80 which includes pin 82 and openings 84. Rotary member 86 is adapted to be rotatably mounted on pin 82, and has a serrated surface. Moveable member 80 is free to move within the plane of cord lock container 46. Spring 88, which is generally wishbone-shaped with two prongs, is adapted to be mounted on spring mounting pin 78.

Holding member 90 includes retainer plate 9 and retaining roller 93. At the end of retaining roller 93 is reduced diameter portion 99. A rivet mounts one end of retaining roller 93 to retaining plate 9, and the reduced diameter portion 99 is affixed to inner wall 56 at opening 95. Holding member 90 is located and partially supported over the space generally between spring mounting pin 78 and serrated surface 76 by means of projection 98 fitting into opening 99 in retaining plate 91, but with sufficient clearance so as to allow moveable member 80 to move within that space, and to allow the rotary member 86 to rotate about pin 82. The components are assembled in a way that one prong of the spring 88 rests against a fixed surface within cord lock container 46, while the other prong is engaged in one of the openings 84 in moveable member 80 in such a manner as to urge the rotary member 86 into engagement with the serrated surface 76 of ramp member 74 such that the rotary member 86 comes into close proximity to retaining roller 93.

It will be appreciated by those skilled in the art that the lift cords 94 can now enter the cord lock container 46 through an opening in inner wall 56 (not shown), wrap over the ramp member 74 to travel between retaining roller 93 and rotary member 86, and thereafter emerge through lift cord opening 72. When the spring 88 urges the moveable member 80 toward the retaining roller 93, the lift cords 94 are locked in position.

It will also be appreciated that the preferred embodiments may include a release cord 96 for separately releasing the lift cord. In particular, a separate release cord 96 may be attached to one of openings 84 in movable member 80 and may then exit through release cord opening 92 and to the exterior of the shade. Release cord opening 92 is positioned above lift cord opening 72, and both are formed in front wall 64 of first control module 14. When the release cord 96 is pulled against the force of spring 88, the rotary member 86 is moved away from retaining roller 93, and the lift cords 94 are released.

FIG. 2 shows lift cords 94 and release cord 96 proximate to each other. If desired, lift cords 94 and release cord 96 may be loosely connected to each other with a pull member 97, beneath which release cord 96 is knotted, but which freely slides around lift cords 94. It will be appreciated that by pulling on the pull member 97, release cord 96 causes moveable member 80 to be pulled against the force of spring 88, so that rotary member 86 moves downward along serrated surface 76 by means of their respective serrated surfaces. This creates a separation between rotary member 86 and retaining roller 93, which thus allows the lift cords 94 to proceed essentially unencumbered, and thus allows the first shade 18 to drop.

End plate 48 is designed to be press fitted into the cord lock container 46 so as to fully enclose and protect the cord lock 70. It has been found that this arrangement permits the lift cords to be threaded from the interior of the headrail 12 into the cord lock container 46 of first control module 14, and then through the cord lock 70 and out to lift cord opening 72. Once the cord lock is operating satisfactorily, the end plate 48 may be mounted into place.

Turning now to the second shade 20, in the preferred embodiment shown in FIGS. 1–3, the second shade 20 includes a weighted rod 100 at the bottom which adds weight and helps the second shade 20 to remain flat when it is lowered. The upper end of second shade 20 is mounted on a roller 102. At one end of roller 102 (the right-hand end as shown in FIG. 2) there is provided an end cap 104. End cap 104 has a circular opening 106, which is adapted to be positioned on a mating circular boss 101 on the interior surface of first module 14 to allow for rotation of the roller 102.

Positioned at the opposite end of roller 102 is second control module 16. Positioned within and forming part of second control module 16 is a clutch 108 having an outer surface adapted to be tightly fitted into the end of roller 102. The clutch 108 rests in housing 110, which is also part of second control module 16. Housing 110 includes extension members 112, 114 which, like extension members 50, 52, allow the housing 110 to be tightly fitted into mating grooves at the second side edge 30 of headrail 12. A screw 116 allows the housing 110 (along with the enclosed clutch 108) to be firmly fastened to the headrail 12 by means of a mating opening (not shown) similar to headrail opening 67. A cord loop 118, which may optionally be held at one end by bracket 120, provides for operation of the clutch 108.

Clutches 108 are well known within the window covering industry. They serve to maintain the rotary position of a roller such as 102, unless and until the user operates the clutch by means of pulling on the cord loop 118 in one direction, which causes rotation of the roller 102 to lift the second shade 20 by a desired amount, or in the opposite direction, which causes rotation of the roller 102 such that the shade is lowered by a desired amount. When the cord is not operated, the roller holds its position. Such clutches are illustrated in, for example, U.S. Pat. Nos. 4,372,432 and 4,433,765, each of which is incorporated herein by reference. It has been found that the clutch sold by ROLLEASE having Model No. RC3 operates effectively in this environment.

To manufacture and assemble a double shade 10 in accordance with the present invention, it is necessary to first obtain a segment of headrail 12 having the proper width. The first shade 18 is prepared by cutting the shade fabric to the appropriate width (which, as noted above, may exceed the width of the headrail 12) and height, punching appropriate holes 40 to accommodate the selected number of lift cords, punching mating holes 44 in bottom surface 26 of the headrail 12, mounting the first shade 18 to the bottom surface 26 with eyelets or the like, and running lift cords from an attachment point on the bottom rail 38 through the holes 40 and 44 and into the interior of the headrail 12.

The first control module 14 may now be attached to the headrail 12. Initially, the cord lock container 46 is mounted to the headrail 12 and fastened with screw 68. The lift cords 94 associated with the first shade 18 are then threaded into the cord lock container 46, threaded through the cord lock 70 and caused to exit through lift cord opening 72. The release cord 96 is also fastened to the movable member 80 within the cord lock 70 and passed through the release cord opening 92 When all of this has been accomplished, the end plate 48 may be placed over the cord lock container 46 and firmly pressed into place.

At this juncture, the second shade 20 may be mounted into the headrail 12. With the end cap 104 in place, and the second shade 20 wrapped around roller 102, those assembled components are inserted into the interior of the headrail 12 so that rounded opening 106 mates with the boss 101 on the interior surface of the cord lock container 46.

The second control module 16, consisting of the housing 110, the clutch 108 and the cord loop 118, may then be mounted to the headrail so that the outer rounded surface of the clutch 108 fits tightly into the end of roller 102. The second shade 20 will emerge through the open rear of headrail 12. The housing 110 is fastened to the headrail 12 by means of screw 116.

When the shade has been completely assembled, it can be mounted to a wall surface by means of mounting brackets 36. Once brackets 36 are fastened to the wall, the fully assembled double shade 10 can be releasably attached to brackets 36 by means of extensions 32, 34 in conventional fashion.

It has been noted that the headrail 12 has an open rear. The second shade 20 exits through this rear opening and then proceeds downward, which arrangement allows the second shade to come very close to the window. For this reason, as noted previously, the arrangement of extensions 32 and 34 and brackets 36 must be such as to allow sufficient space for the second shade 20 to emerge from the headrail and then proceed downward.

It will be appreciated from the foregoing that the use of control modules 14 and 16 makes it possible for the headrail 12 to be free of visible, finished openings for control cords. Instead of having finished openings for control cords in the headrail 12, such openings are provided in the modules 14 and 16. Thus, the headrail 12 need not have neatly finished openings, which facilitates the use of lengthy extrusions of headrail material which can be cut to size as desired.

It also will be appreciated that the movable member 80 within the cord lock 70 moves in a plane perpendicular to the longitudinal direction of the headrail, rather than from side to side. This allows for the second module 16 to be quite thin, thus providing the assembled double shade 10 with an appearance whereby the front face 24 of the headrail 12 is smooth and uninterrupted by any openings for control cords, and in which the visible portions of the first and second modules 14 and 15 are extremely narrow and unobtrusive, appearing to be only slightly wider than the respective cord openings. In a preferred embodiment of the present invention, the first and second control modules 14, 16 appear from the exterior to be only approximately ½" wide, although certain portions of such modules which extend inside the headrail 12 occupy somewhat more longitudinal distance.

When the double shade 10 is mounted and ready for operation, it is possible to lower either the first shade 18 or the second shade 20, or both, as the user sees fit. If the material for the first shade 18 is substantially transparent, and the material for the second shade 20 is substantially opaque, the double shade can be used in a manner which allows most of the light to pass through the shade (by lowering only a substantially transparent first shade 18), or to block out most of the light by lowering only a substantially opaque second shade 20. The user may also desire to lower both shades at the same time to obtain the light-blocking benefits of a substantially opaque second shade 20 and the attractive appearance of the first shade 18 within the room in which the double shade 10 is used.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. A double shade comprising:

a longitudinally extending headrail adapted to be mounted to a stationary surface and having a front surface, a bottom surface and first and second side edges;

first and second shades having upper and lower ends, said first and second shades being mounted at their respective upper ends to said headrail and adapted to move in substantially parallel planes between raised positions and lowered positions;

a first control module mounted at said first side edge of said headrail, said first control module including a mechanism for moving said first shade between raised and lowered positions and for holding said first shade at positions between said raised and lowered positions; and a second control module mounted at said second side edge of said headrail, said second control module including a mechanism for moving said second shade between raised and lowered positions and for holding said second shade at positions between said raised and lowered positions, wherein one of said first and second shades is raised and lowered by at least one lift cord extending through and to said lower end of one of said first and second shades, and wherein one of said first and second control modules includes a cord lock and an end plate removable from the remainder of said control module to allow access to said cord lock, said at least one lift cord extending through said cord lock and outward from said one of said modules.

2. A double shade according to claim 1 wherein one of said first and second shades is mounted to said bottom surface of said headrail.

3. A double shade according to claim 1 wherein said cord lock includes a movable locking member, and wherein said cord lock is operated by moving said locking member in a plane perpendicular to the longitudinal direction of said headrail.

4. A double shade according to claim 3 wherein said first control module includes a front wall, and wherein said at least one lift cord exits said first control module through a lift cord opening in said front surface.

5. A double shade according to claim 3 further comprising a release cord for moving said movable locking member.

6. A double shade according to claim 5, wherein said first control module includes a front wall, and wherein said at least one lift cord exits said first control module through a lift cord opening in said front surface, and wherein said release cord exits said first control module through a release cord opening in said front surface positioned above said lift cord opening.

7. A double shade according to claim 5 wherein said release cord is movably coupled to said at least one lift cord.

8. A double shade according to claim 1 wherein one of said first and second shades is mounted at its upper end to said headrail by mounting said shade to a roller and mounting said roller to said headrail.

9. A double shade according to claim 1, wherein one of said first and second control modules includes a clutch mounted within said control module to selectively drive a roller to raise and lower one of said first and second shades, and a cord loop adapted to drive said clutch and extending outward from said control module.

10. A double shade according to claim 9 wherein said headrail has a rear opening, and wherein said one of said first and second shades is stored on said roller and exits from said headrail through said rear opening.

11. A double shade according to claim 1 wherein said front surface of said headrail is free of openings.

12. A double shade according to claim 1 wherein one of said first and second shades is substantially transparent and the other of said first and second shades is substantially opaque.

13. A double shade according to claim 12 wherein said substantially transparent shade is positioned in front of said substantially opaque shade.

14. A double shade according to claim 1 wherein at least one of said first and second control modules is adapted to be slidably inserted into said headrail at one of said side edges.

15. A double shade according to claim 14 wherein said one of said first and second control modules is fastened to said side edge when said control module is substantially flush with said side edge.

16. A double shade according to claim 1 wherein said headrail has a longitudinal width, and wherein one of said first and second shades has a longitudinal width which is greater than said headrail width.

17. A double shade according to claim 16 wherein said one of said first and second shades extends below one of said first and second control modules.

18. A cord lock comprising:

a cord lock container adapted to be mounted in a vertical plane;

a retaining roller rigidly mounted within said container;

a movable member having a rotary member mounted thereon, said movable member being free to move within said vertical plane between a first position in which said rotary member is located sufficiently close to said retaining roller to prevent movement of a lift cord positioned therebetween, and a second position in which a lift cord is free to move between said rotary member and said retaining roller;

a spring biasing said movable member toward said first position;

a release cord attached to said movable member and adapted to move said movable member away from said first position and toward said second position when said release cord is pulled; and a ramp member rigidly mounted within said container, said rotary member being adapted to rollingly engage said ramp member as said movable member moves between said first and second positions.

19. A cord lock according to claim 18, wherein said ramp member and said rotary member have serrated surfaces.

* * * * *